US011208617B2

(12) United States Patent
Brennan et al.

(10) Patent No.: US 11,208,617 B2
(45) **Date of Patent: *Dec. 28, 2021**

(54) LAUNDRY COMPOSITION ADDITIVE

(71) Applicant: Conopeo, Inc., Englewood Cliffs, NJ (US)

(72) Inventors: Lee James Brennan, Merseyside (GB); Martin Charles Crossman, Merseyside (GB); Jonathan Osler, Merseyside (GB); Geraint Paul Roberts, Cheshire (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/485,081

(22) PCT Filed: Jan. 24, 2018

(86) PCT No.: PCT/EP2018/051675

§ 371 (c)(1),
(2) Date: Aug. 9, 2019

(87) PCT Pub. No.: WO2018/145898

PCT Pub. Date: Aug. 16, 2018

(65) Prior Publication Data

US 2019/0376009 A1 Dec. 12, 2019

(30) Foreign Application Priority Data

Feb. 13, 2017 (EP) ..... 17155836

(51) Int. Cl.

| | |
|---|---|
| ***C11D 3/37*** | (2006.01) |
| ***C11D 17/00*** | (2006.01) |
| ***C11D 3/00*** | (2006.01) |
| ***C11D 3/16*** | (2006.01) |
| ***C11D 3/22*** | (2006.01) |
| ***C11D 3/50*** | (2006.01) |

(52) U.S. Cl.

CPC ..... *C11D 17/0021* (2013.01); *C11D 3/0015* (2013.01); *C11D 3/162* (2013.01); *C11D 3/227* (2013.01); *C11D 3/373* (2013.01); *C11D 3/505* (2013.01)

(58) Field of Classification Search

CPC .. C11D 1/62; C11D 3/001; C11D 3/50; C11D 3/373

See application file for complete search history.

(56) References Cited

U.S. PATENT DOCUMENTS

| | | | |
|---|---|---|---|
| 5,752,981 | A | 5/1998 | Fornelli |
| 6,240,953 | B1 | 6/2001 | Laughlin |
| 6,251,850 | B1 | 6/2001 | Clarke et al. |
| 6,750,191 | B2 | 6/2004 | Kasturi |
| 6,949,498 | B2 | 9/2005 | Murphy et al. |
| 7,407,293 | B2 | 8/2008 | Ishii |
| 8,304,375 | B1 | 6/2012 | Wolff et al. |
| 2002/0019328 | A1 | 2/2002 | Schroeder et al. |
| 2002/0037823 | A1 | 3/2002 | Honma et al. |
| 2002/0077265 | A1 | 6/2002 | Buzzacarini et al. |
| 2002/0128170 | A1 | 9/2002 | DeClercq et al. |
| 2003/0104969 | A1 | 6/2003 | Caswell et al. |
| 2003/0220217 | A1 | 11/2003 | McHattie |
| 2004/0016060 | A1 | 1/2004 | Detering et al. |
| 2004/0033924 | A1 | 2/2004 | Murphy et al. |
| 2004/0058845 | A1 | 3/2004 | Metrot et al. |
| 2004/0092425 | A1 | 5/2004 | Jean-Pol et al. |
| 2004/0103483 | A1* | 6/2004 | Delplancke ..... C11D 3/3723 8/115.51 |
| 2004/0107506 | A1 | 6/2004 | Detering et al. |
| 2004/0121929 | A1 | 6/2004 | Wang et al. |
| 2004/0139559 | A1 | 7/2004 | Detering et al. |
| 2005/0250668 | A1 | 11/2005 | Serobian et al. |
| 2006/0122088 | A1 | 6/2006 | Sadlowski et al. |
| 2007/0105739 | A1 | 5/2007 | Wahl et al. |
| 2007/0111914 | A1 | 5/2007 | Hsu et al. |
| 2007/0128142 | A1 | 6/2007 | Harrison et al. |
| 2007/0163055 | A1 | 7/2007 | Delplancke et al. |
| 2008/0009432 | A1 | 1/2008 | Caswell et al. |
| 2009/0036346 | A1 | 2/2009 | Bird et al. |
| 2009/0069522 | A1 | 3/2009 | Hessefort et al. |
| 2009/0186798 | A1 | 7/2009 | Baston et al. |
| 2010/0325812 | A1 | 12/2010 | Panandiker et al. |
| 2010/0331229 | A1 | 12/2010 | Bianchetti et al. |
| 2011/0039753 | A1 | 2/2011 | Cauvin et al. |
| 2011/0111999 | A1 | 5/2011 | Smets et al. |
| 2011/0209291 | A1 | 9/2011 | Sadlowski et al. |
| 2011/0240065 | A1 | 10/2011 | Panandiker et al. |
| 2011/0277248 | A1 | 11/2011 | Panandiker et al. |

(Continued)

FOREIGN PATENT DOCUMENTS

| | | |
|---|---|---|
| CN | 1332787 | 10/1999 |
| CN | 1277836 | 12/2000 |

(Continued)

OTHER PUBLICATIONS

IPRP2 in PCTEP2018053305; dated Jun. 4, 2019.
IPRP2 in PCTEP2018051675; dated May 17, 2019.
Written Opinion 2 in PCTEP2018053305.
Written Opinion in PTEP2018051675; dated Jan. 22, 2019.
Search Report and Written Opinion in PCTEP2018051675.
S. Ugazio et al.; New Method for Direct Incorporation and Stabilization of Silicone Polymers in Fabric Softeners; SOFW Journal; 2007; pp. 48, 50-52, 54; XP001540614; vol. 133.
Search Report and Written Opinion in EP17155861; dated Aug. 4, 2017.
Search Report and Written Opinion in EP17155838; dated Aug. 2, 2017.

(Continued)

*Primary Examiner* — John R Hardee
(74) *Attorney, Agent, or Firm* — Greenberg Traurig, LLP

(57) ABSTRACT

An ancillary laundry composition comprising: (a) 2.5-30 w.t. % fabric softening silicone; (b) Less than 2 w.t. % surfactant; (c) 0.25-10 w.t. % cationic polymer (d) Water.

1 Claim, No Drawings

(56) References Cited

U.S. PATENT DOCUMENTS

| | | | | |
|---|---|---|---|---|
| 2012/0004156 | A1 | 1/2012 | Panandiker et al. | |
| 2012/0071382 | A1 | 3/2012 | Wang et al. | |
| 2012/0309663 | A1 | 12/2012 | Panandiker et al. | |
| 2013/0232700 | A1 | 9/2013 | Smith et al. | |
| 2014/0023609 | A1 | 1/2014 | Mukherjee et al. | |
| 2014/0369943 | A1 | 12/2014 | Pilz et al. | |
| 2015/0030643 | A1 | 1/2015 | Gartstein et al. | |
| 2015/0197708 | A1 | 7/2015 | Jin | |
| 2015/0330020 | A1 | 11/2015 | van Buskirk et al. | |
| 2016/0024435 | A1 | 1/2016 | Vetter et al. | |
| 2016/0060574 | A1 | 3/2016 | Panandiker | |
| 2016/0060575 | A1* | 3/2016 | Panandiker | C11D 3/3719 510/296 |
| 2016/0168508 | A1 | 6/2016 | Ribaut et al. | |
| 2016/0296459 | A1 | 10/2016 | Sun et al. | |
| 2016/0348042 | A1 | 12/2016 | Schmiedel | |
| 2017/0335245 | A1* | 11/2017 | Burgess | C11D 3/222 |

FOREIGN PATENT DOCUMENTS

| | | | |
|---|---|---|---|
| CN | 1646760 | | 7/2005 |
| CN | 101657530 | | 2/2010 |
| CN | 103668989 | | 3/2014 |
| CN | 103695195 | | 4/2014 |
| CN | 104060472 | | 9/2014 |
| CN | 104487559 | | 4/2015 |
| CN | 104781381 | | 7/2015 |
| CN | 105155257 | | 12/2015 |
| CN | 105421080 | | 3/2016 |
| CN | 205653653 | | 10/2016 |
| CN | 106148006 | | 11/2016 |
| CN | 110291180 | | 9/2019 |
| EP | 1080714 | | 3/2001 |
| EP | 3580319 | | 11/2020 |
| JP | 10001874 | | 1/1998 |
| JP | 2000129577 | A | 5/2000 |
| KR | 101423649 | | 7/2014 |
| WO | WO9839401 | | 9/1998 |
| WO | WO2000024856 | | 5/2000 |
| WO | WO2005079621 | A1 | 9/2005 |
| WO | WO2006088980 | | 8/2006 |
| WO | WO2008120176 | | 10/2008 |
| WO | WO2010120863 | | 10/2010 |
| WO | WO2013189010 | | 12/2013 |
| WO | WO2014079621 | | 5/2014 |
| WO | WO2015078692 | | 6/2015 |
| WO | WO2015078766 | | 6/2015 |
| WO | WO2018145895 | | 8/2018 |
| WO | WO2018145896 | | 8/2018 |
| WO | WO2018145897 | | 8/2018 |

OTHER PUBLICATIONS

Svensson, et al.; Surface Deposition and Phase Behavior of Oppositely Charged Polyion-Surfactant Ion Complexes. 2. A Means to Deliver Silicone Oil to Hydrophilic Surfaces; ACS Applied Materials & Interfaces; Jan. 27, 2010; XP055369144, pp. 143-156; vol. 2, No. 1.

Search Report and Written Opinion in EP17155836; dated Aug. 2, 2017.

Search Report and Written Opinion in EP17155805; dated Jul. 27, 2017.

Search Report and Written Opinion in EP17155812; dated Jul. 3, 2017.

Search Report and Written Opinion in EP17155863; dated Jun. 27, 2017.

Search Report and Written Opinion in PCTEP2018051673; dated Mar. 5, 2018.

Search Report and Written Opinion in PCTEP2018053289.

Search Report and Written Opinion in PCTEP2018051672; dated Apr. 23, 2018.

Search Report and Written Opinion in PCTEP2018053305; dated Mar. 27, 2018.

Search Report and Written Opinion in PCTEP2018053030; dated Apr. 24, 2018.

Written Opinion 2 in PCTEP2018051674; dated Jan. 16, 2019.

Anonymous; Viscosity Tables; V&P Scientific Inc Internet article; 2010; pp. 1-4; XP055453259 www.vp-sci.com.

Search Report and Written Opinion in EP17155804; dated May 11, 2017.

Search Report and Written Opinion in PCTEp2018051674; dated Apr. 20, 2018.

IPRP2; dated May 9, 2019.

Written Opinion 2 in PCTEP2018051672; dated Jan. 17, 2019.

Written Opinion 2 in PCTEP2018053030; dated Jan. 14, 2019.

* cited by examiner

LAUNDRY COMPOSITION ADDITIVE

FIELD OF THE INVENTION

The present invention relates to ancillary laundry compositions providing improved softening to fabrics. In particular ancillary laundry compositions comprising silicones and low levels of surfactants.

BACKGROUND OF THE INVENTION

Textile fabrics, including clothes can often feel harsh after the laundry process. To reduce the harshness experienced after multiple wash cycles, technologies have been developed to increase the softness of fabrics post wash. These technologies include fabric conditioner compositions and softening systems added to detergent compositions.

WO 2014/079621 discloses a laundry detergent composition comprising: surfactant, fabric softening silicone and cationic polysaccharide polymer.

However there is a need to improve the softness benefit provided. It has been found that compositions according to the present invention provide superior softening than traditional laundry compositions comprising fabric softening silicones.

SUMMARY OF THE INVENTION

In a first aspect of the present invention is provided an ancillary laundry composition comprising:

(a) 2-60 w.t. % fabric softening silicone;

(b) Less than 5 w.t. % surfactant;

(c) 0.25-10 w.t. % cationic polymer (d) Water

In a second aspect of the present invention is provided a method of laundering fabrics, wherein the fabrics are treated with a laundry detergent composition and an ancillary laundry composition comprising:

(a) 2 to 60 w.t. % fabric softening silicone;

(b) 0 to 5 w.t. % surfactant;

(c) 0.25-20 w.t. % cationic polymer;

(d) Water.

In a third aspect of the present invention is provided a use of the ancillary laundry composition disclosed herein to enhance the benefits provided by silicone to a fabric.

DETAILED DESCRIPTION OF THE INVENTION

Product Form

The present invention is concerned with ancillary laundry compositions. These are compositions intended to be used in addition to the consumer's regular laundry products. For example in addition to a wash detergent and/or rinse added fabric conditioners. However consumers may choose to use the product in anyway. The ancillary laundry composition may be added into that wash liquor at any point in the wash cycle.

Fabric Softening Silicone

Silicones and their chemistry are described in, for example in The Encyclopaedia of Polymer Science, volume 11, p 765.

Silicones suitable for the present invention are fabric softening silicones. Non-limiting examples of such silicones include: non-functionalised silicones such as polydimethylsiloxane (PDMS), alkyl (or alkoxy) functionalised silicones, and functionalised silicones or copolymers with one or more different types of functional groups such as amino, phenyl, polyether, acrylate, siliconhydride, carboxy acid, phosphate, betaine, quarternized nitrogen and mixtures thereof.

Preferably the silicone is a functionalised silicone.

The molecular weight of the silicone is preferably from 1,000 to 500,000, more preferably from 2,000 to 250,000 even more preferably from 5,000 to 100,000.

Preferably the silicone is an anionic functionalised silicone. Examples of fabric softening anionic silicones suitable for the current invention include silicones containing the following functionalities; carboxylic, sulphate, sulphonic, phosphate and/or phosphonate functionality.

Preferably the anionic silicones of the current invention comprise silicones having a functionality selected from; carboxylic, sulphate, sulphonic, phosphate and/or phosphonate functionality or mixtures thereof. More preferably the anionic silicone of the present invention comprises carboxyl functionalised silicones. Most preferably the anionic silicone of the current invention is a carboxyl silicone.

For the purposes of the current invention, the anionic silicone may be in the form of the acid or the anion. For example for a carboxyl functionalised silicone, may be present as a carboxylic acid or carboxylate anion.

An example of a commercially available anionic functional material are: X22-3701E from Shin Etsu and Pecosil PS-100 from Pheonix Chemical.

Preferably the anionic silicone has an anionic group content of at least 1 mol %, preferably at least 2 mol %.

The anionic group(s) on the anionic silicones of the present invention are preferably located in pendent positions on the silicone i.e. the composition comprises anionic silicones wherein the anionic group is located in a position other than at the end of the silicone chain. The terms 'terminal position' and 'at the end of the silicone chain' are used to indicate the terminus of the silicone chain.

When the silicones are linear in nature, there are two ends to the silicone chain. In this case the anionic silicone preferably contains no anionic groups located on a terminal position of the silicone.

When the silicones are branched in nature, the terminal position is deemed to be the two ends of the longest linear silicone chain. Preferably no anionic functionality is not located on the terminus of the longest linear silicone chain.

Preferred anionic silicones are those that comprise the anionic group at a mid-chain position on the silicone. Preferably the anionic group(s) of the anionic silicone are located at least five Si atoms from a terminal position on the silicone. Preferably the anionic groups are distributed randomly along the silicone chain.

The silicone composition of the current invention may be in the form of an emulsion or as a silicone fluid. In a preferred embodiment the silicone is in the form of a silicone emulsion.

When the silicone is in an emulsion, the particle size can be in the range from about 1 nm to 100 microns and preferably from about 10 nm to about 10 microns including microemulsions (<150 nm), standard emulsions (about 200 nm to about 500 nm) and macroemulsions (about 1 micron to about 20 microns).

The fabric softening silicones may be an emulsion or a fluid, preferably an emulsion.

Ancillary laundry compositions according to the current invention preferably comprise silicone at a level of 2 to 60 w.t % of the formulation, preferably 2.5 to 30 w.t. % of the formulation, more preferably 3 to 20 w.t. % of the formulation.

Surfactant

The term surfactant covers all categories of surfactant, including: anionic, cationic, non-ionic and zwitterion surfactants. Many surfactants are traditionally used in laundry compositions: laundry detergent compositions often comprise anionic and non-ionic surfactants whereas fabric conditioning compositions often comprise cationic surfactants.

The composition of the present invention comprises less than 5 w.t. % surfactant, preferably less than 2 w.t. % surfactant, more preferably less than 1 w.t. % surfactant and most preferably less than 0.85 w.t. % surfactant. Composition can be completely free of non-emulsified surfactant (ie surfactant not-used to emulsify the droplets of benefit agent).

Surfactants used to emulsify benefit agents such as silicones may be included at a level higher than some of the preferred embodiments above when high levels of benefit agents are used. The ranges above are intended for surfactants present for purposes other than emulsifying the benefit agent, such as for cleaning and softening.

In other words, the compositions may comprise 0 to 5 w.t. % surfactant, preferably, the composition of the present invention comprises 0 to 2 w.t. % surfactant, more preferably, 0 to 1 w.t. % surfactant, most preferably 0 to 0.85 w.t. %. The composition can be completely free of non-emulsified surfactant (ie surfactant not-used to emulsify the droplets of benefit agents).

Cationic Polymer

The ancillary laundry composition of the present invention comprises a cationic polymer. This refers to polymers having an overall positive charge.

The cationic polymer may be naturally derived or synthetic. Examples of suitable cationic polymers include: acrylate polymers, cationic amino resins, cationic urea resins, and cationic polysaccharides, including: cationic celluloses, cationic guars and cationic starches.

The cationic polymer of the present invention may be categorized as a polysaccharide-based cationic polymer or non-polysaccharide based cationic polymers.

Polysaccharide-based cationic polymers:

Polysaccharide based cationic polymers include cationic celluloses, cationic guars and cationic starches. Polysaccharides are polymers made up from monosaccharide monomers joined together by glycosidic bonds.

The cationic polysaccharide-based polymers present in the compositions of the invention have a modified polysaccharide backbone, modified in that additional chemical groups have been reacted with some of the free hydroxyl groups of the polysaccharide backbone to give an overall positive charge to the modified cellulosic monomer unit.

Non polysaccharide-based cationic polymers:

A non-polysaccharide-based cationic polymer is comprised of structural units, these structural units may be non-ionic, cationic, anionic or mixtures thereof. The polymer may comprise non-cationic structural units, but the polymer must have a net cationic charge.

The cationic polymer may consists of only one type of structural unit, i.e., the polymer is a homopolymer. The cationic polymer may consists of two types of structural units, i.e., the polymer is a copolymer. The cationic polymer may consists of three types of structural units, i.e., the polymer is a terpolymer. The cationic polymer may comprises two or more types of structural units. The structural units may be described as first structural units, second structural units, third structural units, etc. The structural units, or monomers, may be incorporated in the cationic polymer in a random format or in a block format.

The cationic polymer may comprise a nonionic structural units derived from monomers selected from: (meth)acrylamide, vinyl formamide, N,N-dialkyl acrylamide, N,N-dialkylmethacrylamide, $C_1$-$C_{12}$ alkyl acrylate, $C_1$-$C_{12}$ hydroxyalkyl acrylate, polyalkylene glycol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and mixtures thereof.

The cationic polymer may comprise a cationic structural units derived from monomers selected from: N,N-dialkylaminoalkyl methacrylate, N,N-dialkylaminoalkyl acrylate, N,N-dialkylaminoalkyl acrylamide, N,N-dialkylaminoalkylmethacrylamide, methacylamidoalkyl trialkylammonium salts, acrylamidoalkylltrialkylamminium salts, vinylamine, vinylimine, vinyl imidazole, quaternized vinyl imidazole, diallyl dialkyl ammonium salts, and mixtures thereof.

Preferably, the cationic monomer is selected from: diallyl dimethyl ammonium salts (DADMAS), N,N-dimethyl aminoethyl acrylate, N,N-dimethyl aminoethyl methacrylate (DMAM), [2-(methacryloylamino)ethyl]trl-methylammonium salts, N,N-dimethylaminopropyl acrylamide (DMAPA), N,N-dimethylaminopropyl methacrylamide (DMAPMA), acrylamidopropyl trimethyl ammonium salts (APTAS), methacrylamidopropyl trimethylammonium salts (MAPTAS), quaternized vinylimidazole (QVi), and mixtures thereof.

The cationic polymer may comprise a anionic structural units derived from monomers selected from: acrylic acid (AA), methacrylic acid, maleic acid, vinyl sulfonic acid, styrene sulfonic acid, acrylamidopropylmethane sulfonic acid (AMPS) and their salts, and mixtures thereof.

Some cationic polymers disclosed herein will require stabilisers i.e. materials which will exhibit a yield stress in the ancillary laundry composition of the present invention. Such stabilisers may be selected from: thread like structuring systems for example hydrogenated castor oil or trihydroxystearin e.g. Thixcin ex. Elementis Specialties, cross-linked polyacrylic acid for example Carbopol ex. Lubrizol and gums for example carrageenan.

Preferably the cationic polymer is selected from; cationic polysaccharides and acrylate polymers. More preferably the cationic polymer is a cationic polysaccharide.

The molecular weight of the cationic polymer is preferably greater than 20 000 g/mol, more preferably greater than 25 000 g/mol. The molecular weight is preferably less than 2 000 000 g/mol, more preferably less than 1 000 000 g/mol.

Ancillary laundry compositions according to the current invention preferably comprise cationic polymer at a level of 0.25 to 10 w.t % of the formulation, preferably 0.35 to 7.5 w.t. % of the formulation, more preferably 0.5 to 5 w.t. % of the formulation Perfumes The ancillary laundry compositions of the present invention preferably comprises a perfume composition. Perfume may be provided either as a free oil and/or in a microcapsule.

The ancillary laundry composition of the present invention may comprise one or more perfume compositions. The perfume compositions may be in the form of a mixture or free perfumes compositions, a mixture of encapsulated perfume compositions or a mixture of encapsulated and free oil perfume compositions.

Useful perfume components may include materials of both natural and synthetic origin. They include single compounds and mixtures. Specific examples of such components may be found in the current literature, e.g., in Fenaroli's Handbook of Flavor Ingredients, 1975, CRC Press; Synthetic Food Adjuncts, 1947 by M. B. Jacobs, edited by Van Nostrand; or Perfume and Flavor Chemicals by S. Arctander 1969, Montclair, N.J. (USA). These substances are well known to the person skilled in the art of perfuming, flavouring, and/or aromatizing consumer products.

Free oil perfumes and fragrances may be added to the ancillary laundry composition. These may be to scent the ancillary laundry composition, to provide scent in the washing process or to provide scent to the textiles after the wash.

Particularly preferred perfume components are blooming perfume components and substantive perfume components. Blooming perfume components are defined by a boiling point less than 250° C. and a Log P greater than 2.5. Substantive perfume components are defined by a boiling point greater than 250° C. and a Log P greater than 2.5. Preferably a perfume composition will comprise a mixture of blooming and substantive perfume components. The perfume composition may comprise other perfume components.

It is commonplace for a plurality of perfume components to be present in a free oil perfume composition. In the compositions for use in the present invention it is envisaged that there will be three or more, preferably four or more, more preferably five or more, most preferably six or more different perfume components. An upper limit of 300 perfume ingredients may be applied.

Free perfume may preferably be present in an amount from 0.01 to 20% by weight, more preferably from 0.05 to 10% by weight, even more preferably from 0.1 to 5.0%, most preferably from 0.15 to 5.0% by weight, based on the total weight of the composition.

When perfume components are in a microcapsule, suitable encapsulating material, may comprise, but are not limited to; aminoplasts, proteins, polyurethanes, polyacrylates, polymethacrylates, polysaccharides, polyamides, polyolefins, gums, silicones, lipids, modified cellulose, polyphosphate, polystyrene, polyesters or combinations thereof.

Perfume components contained in a microcapsule may comprise odiferous materials and/or pro-fragrance materials.

Particularly preferred perfume components contained in a microcapsule are blooming perfume components and substantive perfume components. Blooming perfume components are defined by a boiling point less than 250° C. and a Log P greater than 2.5. Substantive perfume components are defined by a boiling point greater than 250° C. and a Log P greater than 2.5. Preferably a perfume composition will comprise a mixture of blooming and substantive perfume components. The perfume composition may comprise other perfume components.

It is commonplace for a plurality of perfume components to be present in a microcapsule. In the compositions for use in the present invention it is envisaged that there will be three or more, preferably four or more, more preferably five or more, most preferably six or more different perfume components in a microcapsule. An upper limit of 300 perfume ingredients may be applied.

Encapsulated perfume may preferably be present in an amount from 0.01 to 20% by weight, more preferably from 0.05 to 10% by weight, even more preferably from 0.1 to 5.0%, most preferably from 0.15 to 5.0% by weight, based on the total weight of the composition.

If the liquid ancillary composition comprises a microcapsules, a structurant may be required, non-limiting examples of suitable structurants include: pectine, alginate, arabinogalactan, carageenan, gellan gum, xanthum gum, guar gum, acrylates/acrylic polymers, water-swellable clays, fumed silicas, acrylate/aminoacrylate copolymers, and mixtures thereof. Preferred dispersants herein include those selected from the group consisting of acrylate/acrylic polymers, gellan gum, fumed silicas, acrylate/aminoacrylate copolymers, water-swellable clays, and mixtures thereof. Preferably a structurant is selected from acrylate/acrylic polymers, gellan gum, fumed silicas, acrylate/aminoacrylate copolymers, water-swellable clays, and mixtures thereof.

When present, a structurant is preferably present in an amount of 0.001-10 w.t. % percent, preferably from 0.005-5 w.t. % more preferably 0.01-1 w.t. %.

Rheology Modifier

In some embodiments of the present invention, the ancillary laundry compositions of the present invention may comprise rheology modifiers. These may be inorganic or organic, polymeric or non polymeric. A preferred type of rheology modifiers are salts.

Viscosity

The composition of the present invention preferably has a viscosity of less than 15000 Pa·s. Preferably the present invention has a viscosity of more than 400 Pa·s. Viscosity measurements were carried out at 25° C., using a 4 cm diameter 2° cone and plate geometry on a DHR-2 rheometer ex. TA instruments.

In detail, all measurements were conducted using a TA-Instruments DHR-2 rheometer with a 4 cm diameter 2 degree angle cone and plate measuring system. The lower Peltier plate was used to control the temperature of the measurement to 25° C. The measurement protocol was a 'flow curve' where the applied shear stress is varied logarithmically from 0.01 Pa to 400 Pa with 10 measurement points per decade of stress. At each stress the shear strain rate is measured over the last 5 seconds of the 10 second period over which the stress is applied with the viscosity at that stress being calculated as the quotient of the shear stress and shear rate.

For those systems which exhibit a low shear viscosity plateau over large shear stress ranges, to at least 1 Pa, the characteristic viscosity is taken as being the viscosity at a shear stress of 0.3 Pa. For those systems where the viscosity response is shear thinning from low shear stress the characteristic viscosity is taken as being the viscosity at a shear rate of 21 s-1.

Other Optional Ingredients

The ancillary laundry composition of the present invention may comprise other ingredients suitable for laundry compositions which will be known to the person skilled in the art. Among such materials there may be mentioned: antifoams, encapsulated perfumes and fragrances, insect repellents, shading or hueing dyes, preservatives (e.g. bactericides), enzymes, dye transfer inhibitors, pH buffering agents, perfume carriers, hydrotropes, anti-redeposition agents, soil-release agents, softening agents, polyelectrolytes, anti-shrinking agents, anti-wrinkle agents, anti-oxidants, dyes, colorants, fluorescent agents, sunscreens, anti-corrosion agents, anti-static agents, sequestrants and ironing aids. The products of the invention may contain pearlisers and/or opacifiers. A preferred sequestrant is HEDP, an abbreviation for Etidronic acid or 1-hydroxyethane 1,1-diphosphonic acid.

Method of Using the Ancillary Laundry Composition

In a preferred embodiment of the present invention, the ancillary laundry composition of the present invention is used in addition to a laundry detergent.

One aspect of the present invention is a method of laundering fabrics, wherein the fabrics are treated with a laundry detergent composition and an ancillary laundry composition comprising:

(a) 2 to 60 w.t. % fabric softening silicone;

(b) 0 to 5 w.t. % surfactant;

(c) 0.25-20 w.t. % cationic polymer;

(d) Water.

In a preferred embodiment the ancillary laundry composition is added to the laundry process in a volume of 2-100 ml, more preferably a volume of 2-50 ml, even more preferably a volume of ml 2-30 ml, most preferably 2-20 ml.

The compositions of the present invention are preferably used in conjunction with a main wash or rinse added laundry composition.

The ancillary product may be added to the drum of draw of a washing machine either with a the laundry detergent, after a detergent or before a laundry detergent. Most preferably the ancillary product is added to the drum or draw after the detergent.

Use of the Ancillary Laundry Composition

In one aspect of the present invention, the ancillary laundry composition of the present invention is used to enhance the benefits provided by silicone to a fabric The benefits may be defined as: softness, elastic recovery, drape, shape, anti-creasing, wrinkle prevention, abrasive damage.

Preferably the benefit is defined as softness. i.e. use of the ancillary composition to enhance softening.

EXAMPLE

Method of Preparing Example Laundry Formulations:

Water and hydrotropes were mixed together at ambient temperature for 2-3 minutes at a shear rate of 150 rpm using a Janke & Kunkel IKA RW20 overhead mixer. Salts and alkalis were added and mixed for 5 minutes prior to addition of surfactants and fatty acid. The mixture was exothermic and allowed to cool to <30° C. The deposition polymer[2] (when present), silicone emulsion[1] (when present) and any remaining components such as perfume, preservatives and dyes are added.

Method of Producing Example Serum:

Demineralised water was added to the silicone emulsion[1] and mixed for 15 mins at 250 rpm using a Janke & Kunkel IKA RW20 overhead mixer. The solid deposition polymer[2] was added slowly over the top and mix for further 20 mins increasing the rotor speed to effect visible bulk mixing.

TABLE 1

Example Compositions

| Ingredient | Laundry detergent with silicone (w.t. %) | Laundry detergent without silicone (w.t. %) | Ancillary Laundry Composition (w.t. %) |
|---|---|---|---|
| Glycerol | 3.5 | 3.5 | — |
| TEA | 1.25 | 1.25 | — |
| Citric acid | 1.0 | 1.0 | — |
| Neodol 25-7 | 4.75 | 4.75 | — |
| LAS acid | 4.0 | 4.0 | — |

TABLE 1-continued

Example Compositions

| Ingredient | Laundry detergent with silicone (w.t. %) | Laundry detergent without silicone (w.t. %) | Ancillary Laundry Composition (w.t. %) |
|---|---|---|---|
| Fatty Acid | 0.7 | 0.7 | — |
| Lauryl ether sulphate - Sodium salt | 2.0 | 2.0 | — |
| Silicone[1] | 0.6 | 0 | 5 |
| Deposition polymer[2] | 0.3 | 0 | 2 |
| NaOH | to pH 8-8.5 | to pH 8-8.5 | to pH 7-8 |
| Minors | <5 | <5 | <5 |
| Water | to 100 | to 100 | to 100 |

Silicone[1] - Silicone added as a 30% emulsion ex. Wacker Silicone. The silicone comprised a carboxy group in a mid-chain pendent position.
Deposition polymer[2] - Ucare ™ polymer LR400 ex. Dow Comparison of Formulations:

A wash cycle was carried out using 6 (20 cm×20 cm) pieces of terry towelling and a polycotton ballast. The total wash load was 2.0 kg. The towelling was mixed with the ballast fabric in a random order before adding into a Miele front loading washing machine.

Detergent was Added as Follows:

Wash A: 100 g Laundry detergent with silicone

Wash 1: 100 g Laundry detergent without silicone and 10 g Ancillary Laundry Composition to the wash drawer The machine was programed to a standard 40° C. cotton cycle. The towelling swatches were line dried between wash cycles. 5 wash cycles were performed.

The towels were measured for softness using a Phabrometer® ex. Nu Cybertek, Inc.

TABLE 2

Softness measurements results

| | Average softness | Standard deviation |
|---|---|---|
| Pre-wash sample | 9.887 | 0.272 |
| Wash A | 9.654 | 0.155 |
| Wash 1 | 9.193 | 0.220 |

Despite having slightly lower levels of silicone and deposition polymer in Wash 1, the fabric is significantly softer.

The invention claimed is:

1. A method of laundering fabrics:

first treating the fabric with a laundry detergent composition without silicone comprising:

(a) anionic surfactant;

(b) non-ionic surfactant; and second treating the fabric with an ancillary laundry composition comprising:

(a) 2.5 to 30 w.t. % fabric softening silicone;

(b) 0 to 2 w.t. % surfactant;

(c) 0.25 to 20 w.t. % cationic polymer; and (d) water, wherein the fabric softening silicone is an anionic functionalised silicone and the fabric softening silicone is an emulsion.

* * * * *